US011505374B2

(12) United States Patent
Goldberg et al.

(10) Patent No.: US 11,505,374 B2
(45) Date of Patent: Nov. 22, 2022

(54) CHILD RESISTANT MAZE CONTAINER SYSTEM WITH COMBINATION ENTRY-EXIT GROOVE

(71) Applicant: Mazetech, LLC, Wayne, PA (US)

(72) Inventors: Barry A Goldberg, Highland Park, IL (US); Duane Sawyer, Newton, KS (US)

(73) Assignee: Mazetech, LLC, Wayne, PA (US)

( * ) Notice: Subject to any disclaimer, the term of this patent is extended or adjusted under 35 U.S.C. 154(b) by 0 days.

(21) Appl. No.: 16/997,477

(22) Filed: Aug. 19, 2020

(65) Prior Publication Data

US 2022/0055805 A1 Feb. 24, 2022

(51) Int. Cl.
*B65D 50/04* (2006.01)

(52) U.S. Cl.
CPC ..... *B65D 50/04* (2013.01)

(58) Field of Classification Search
CPC ..... B65D 50/04; B65D 50/043; A61J 1/00
USPC ..... 215/43, 222
See application file for complete search history.

(56) References Cited

U.S. PATENT DOCUMENTS

| | | | | |
|---|---|---|---|---|
| 1,089,887 | A | 3/1914 | Waye | |
| 3,212,662 | A * | 10/1965 | Webb | B65D 50/061 215/208 |
| 3,402,842 | A | 9/1968 | Millan | |
| 3,422,977 | A | 1/1969 | Shaw | |
| 3,451,576 | A | 6/1969 | Lewis | |
| 2,947,431 | A | 8/1969 | Haynes | |
| 3,497,096 | A | 2/1970 | Smith | |
| 3,656,647 | A | 4/1972 | Swinn | |
| 3,828,957 | A | 8/1974 | Marchant | |
| 4,071,156 | A | 1/1978 | Lowe | |
| 4,782,963 | A | 11/1988 | Hunter | |
| 4,991,729 | A | 2/1991 | Hunter | |
| 5,423,441 | A | 6/1995 | Conti | |
| 5,566,845 | A | 10/1996 | Frank | |
| 5,740,993 | A | 4/1998 | Conti | |
| 5,819,967 | A | 10/1998 | Lo | |
| 5,829,641 | A | 11/1998 | Bartsch | |
| 8,113,366 | B2 | 2/2012 | House | |
| 8,511,491 | B2 | 2/2013 | House | |
| 2001/0047976 | A1 | 12/2001 | Frank | |

* cited by examiner

*Primary Examiner* — Anthony D Stashick
*Assistant Examiner* — Raven Collins
(74) *Attorney, Agent, or Firm* — Ballard Spahr LLP

(57) ABSTRACT

A child resistant maze type container system is disclosed. The system includes a cylindrical container member that includes a plurality of mazes thereon. A closure member includes studs for engaging the mazes and to releasably secure the closure to the container.

17 Claims, 9 Drawing Sheets

CHILD RESISTANT MAZE CONTAINER SYSTEM WITH COMBINATION ENTRY-EXIT GROOVE

This application claims priority to U.S. provisional application 62/981,510 filed Feb. 25, 2020 the teachings of which are incorporated by reference in their entirety herein.

TECHNICAL BACKGROUND

Pill containers, as well as certain types of liquid containers and the like, involve snap-on and threaded closures. Snap-on and threaded closures, which may be put on and off on the container, are of great convenience to the user. Snap-on and threaded closures, however, enable children to open such containers and to be exposed to potentially harmful contents. Containers that employ snap-on and threaded closures therefore should be resistant to opening by children, especially children under age 5.

A child resistant package must satisfy specific test standards to comply with protocol specified by the U.S. Consumer Product Safety Commission ("CPSC"). These standards are child resistance effectiveness (CRE) and older adult use effectiveness ('OAUE). CRE is the percentage of children in a group that are unable to open the package within a specified time. CRE is measured by asking pairs of children in a specified age group (30% aged 42-44 months, 40% aged 45-48 months, and 30% aged 49-51 months) to open the package in a specified time period both before and after a nonverbal demonstration. Currently, the CPSC requires a CRE of 85 percent before a demonstration and 80 percent after a demonstration. OAUE is the percentage of adults in a group that is able to open and close the package. OAUE is measured by asking individual adults in a specified age group (typically 60-75 years) to open and close a package using instructions supplied with it in a specified time period. Currently, the CPSC requires an OAUE of ninety percent based on pictorial or written instructions.

Maze type packages are known in the art. These types of packages employ mazes formed of intersecting grooves. Two types of motion typically are employed to open such a package: (1) rotation and (2) linear (usually axial) motion. The sequence of steps employed typically includes alternating a rotary motion with an axial motion. Although maze type packages exist in the prior art, a need continues for maze type packages which are both child resistant and easily opened by adults, particularly elderly adults.

BRIEF DESCRIPTION OF THE DRAWINGS

The invention can be more clearly understood by reference to the drawings forming a part of this disclosure wherein like characters indicate like parts throughout the several views.

SUMMARY

Figure 1:
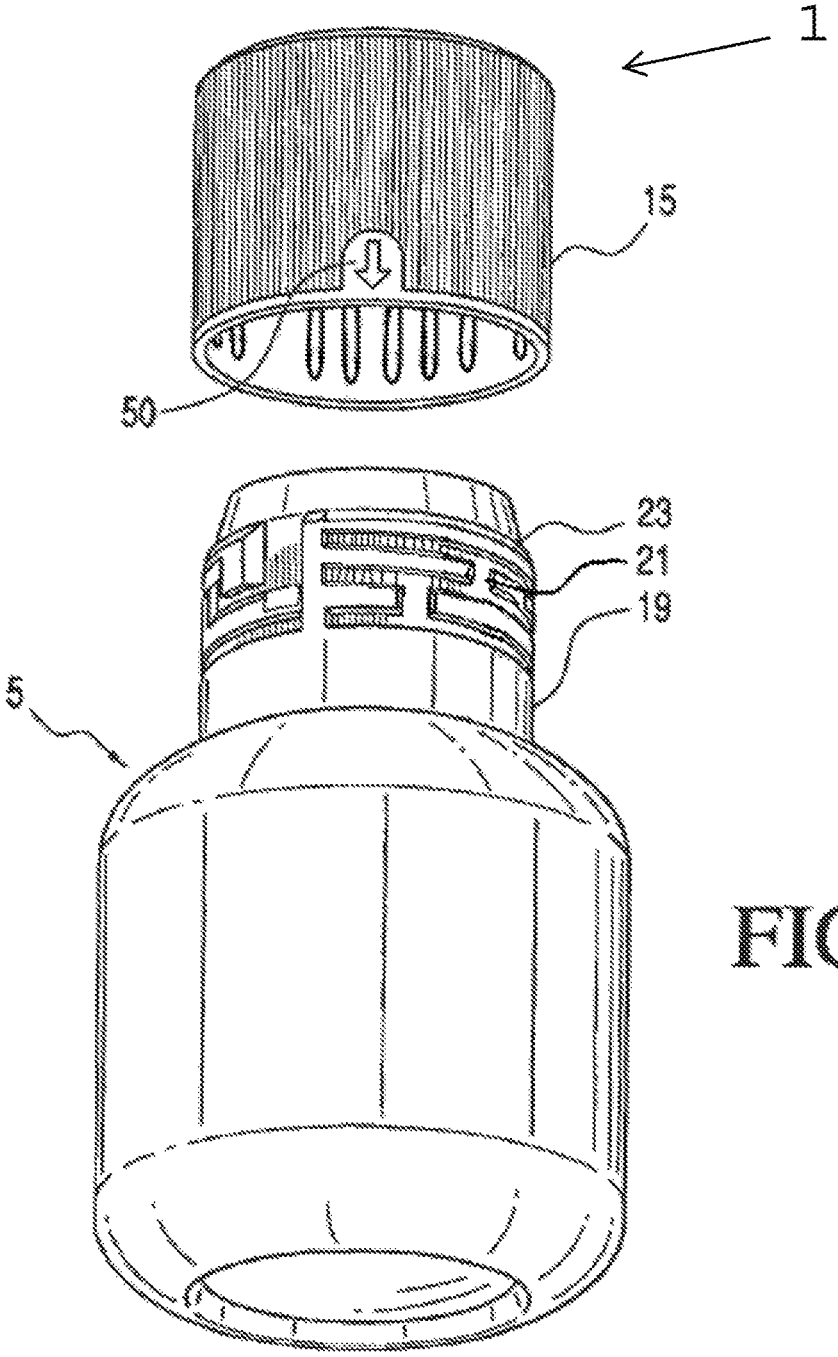
FIG. 1 is an exploded view of a maze container system having a container and a closure.
Figure 2:
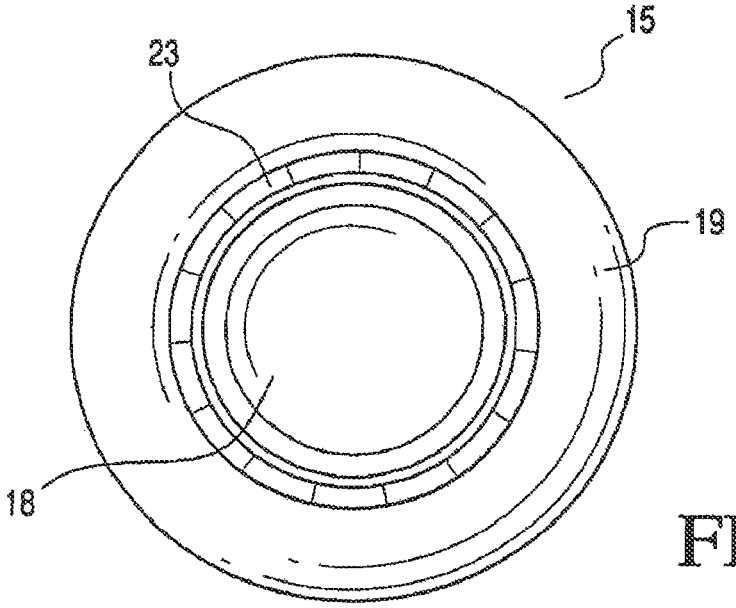
FIG. 2 is a top view of the container of FIG. 1.

In an aspect, the invention relates to a container that includes a neck section 17 and a body section 19, the neck section 17 having one or more mazes 21 thereon. At least one of the mazes 21 includes a plurality of ribs 23 configured to define a first lowermost circumferential groove (A) that has a bottom surface and a locking region 9 that has any of a detent and a stud retainer therein. Maze 21 further includes a second circumferential groove (C) having closed ends, and a third circumferential groove (E), and a fourth circumferential groove (G), and a first axial groove (B), and a second axial groove (D), and a third axial groove (F), and an axial entry-exit groove (H). The second circumferential groove (C) is disposed above the first lowermost circumferential groove (A), the fourth circumferential groove (G) is disposed above the first lowermost circumferential groove (A) and is circumferentially disposed from the second circumferential groove (C). The third circumferential groove (E) is disposed above each of the first lowermost circumferential groove (A) and the second circumferential groove (C) and the fourth circumferential groove (G), and the first axial groove (B) intersects the first lowermost circumferential groove (A) and the second circumferential groove (C), The second axial groove (D) intersects the second circumferential groove (C) and the third circumferential groove (E) and the second axial groove (D) is laterally disposed from the first axial groove (B). The third axial groove (F) intersects each of the third circumferential groove (E) and the fourth circumferential groove (G) and the third axial groove (F) is circumferentially disposed from each of the first axial groove (B) and the second axial groove (D), The axial entry-exit groove (H) intersects the fourth circumferential groove (G) and the axial entry-exit groove (H) is circumferentially disposed from each of the third axial groove (F), the second axial groove (D) and the first axial groove (B) The axial entry-exit groove (H) is configured both to downwardly receive a stud 27 on a closure 15 for securing the closure 15 onto neck section 17 and to upwardly receive stud 27 for removing the closure 15 from neck section 17. The detent has a lowermost surface configured to enable the stud 27 to pass under the lowermost surface of the detent.

In another aspect, the invention relates to a maze container system which includes a closure 15 and a container 5 having a neck section 17 and a body section 19. The neck section 17 has one or more mazes 21 and an axial entry-exit groove (H) in communication with at least one of the mazes 21. At least one of the mazes 21 has a plurality of ribs 23 configured to define a first lowermost circumferential groove (A) having a bottom surface and a locking region 9 that includes any of a detent and a stud retainer therein. The maze further includes a second circumferential groove (C) that has closed ends, and a third circumferential groove (E), and a fourth circumferential groove (G), and a first axial groove (B), and a second axial groove (D), and a third axial groove (F), wherein the second circumferential groove (C) is disposed above the first lowermost circumferential groove (A). The fourth circumferential groove (G) is disposed above the first lowermost circumferential groove (A) and is circumferentially disposed from the second circumferential groove (C). The third circumferential groove (E) is disposed above each of the first lowermost circumferential groove (A) and the second circumferential groove (C) and the fourth circumferential groove (G), and the first axial groove (B) intersects the first lowermost circumferential groove (A) and the second circumferential groove (C). The second axial groove (D) intersects each of the second circumferential groove (C) and the third circumferential groove (E) and the second axial groove (D) is laterally disposed from the first axial groove (B). The third axial groove (F) intersects each of the third circumferential groove (E) and the fourth circumferential groove (G) and the third axial groove (F) is circumferentially disposed from each of the first axial groove (B) and the second axial groove (D). The axial entry-exit groove (H) communicates with the fourth circumferential groove (G) and the axial entry-exit groove (H) is circumferentially disposed from each of the third axial groove (F), the second axial groove (D) and the first axial groove (B). The closure 15 has a laterally spaced stud 27 for engaging the mazes 21 to secure the closure 15 onto the container 5. The axial entry-exit groove (H) is configured both to downwardly receive stud 27 for securing closure 15 onto neck section 17 and to upwardly receive stud 27 for removing closure 15 from neck section 17.

In yet another aspect, the invention relates to a maze container system that includes a closure 15 and a container 5 that includes a neck section 17 and a body section 19. The neck section 17 includes one or more mazes 21 thereon that have a plurality of ribs 23 configured to define a first lowermost circumferential groove (A) having a bottom surface and a locking region 9 having any of a detent and a stud retainer therein. The maze further includes a second circumferential groove (C) having closed ends, and a third circumferential groove (E), and a fourth circumferential groove (G), and a first axial groove (B), and a second axial groove (D), and a third axial groove (F), and an axial entry-exit groove (H). The second circumferential groove (C) is disposed above the first lowermost circumferential groove (A), the fourth circumferential groove (G) is disposed above the first lowermost circumferential groove (A) and is circumferentially disposed from the second circumferential groove (C).The third circumferential groove (E) is disposed above each of the first lowermost circumferential groove (A) and the second circumferential groove (C) and the fourth circumferential groove (G).The first axial groove (B) intersects the first lowermost circumferential groove (A) and the second circumferential groove (C). The second axial groove (D) intersects the second circumferential groove (C) and the third circumferential groove (E) and the second axial groove (D) is laterally disposed from the first axial groove (B). The third axial groove (F) intersects each of the third circumferential groove (E) and the fourth circumferential groove (G) and the third axial groove (F) is circumferentially disposed from each of the first axial groove (B) and the second axial groove (D). The axial entry-exit groove (H) intersects fourth circumferential groove (G). The axial entry-exit groove (H) is circumferentially disposed from each of the third axial groove (F), the second axial groove (D) and the first axial groove (B). Closure 15 includes a laterally spaced stud 27 for engaging the mazes 21 to secure the closure 15 onto the container 5 and the axial entry-exit groove (H) is configured both to downwardly receive stud 27 for securing closure 15 onto neck section 17 and to upwardly receive stud 27 for removing closure 15 from neck section 17.

DETAILED DESCRIPTION

The closure and container components of the maze container system may be made from materials such as but not limited to glass, metal, plastics such as but not limited to polyethylene and polypropylene, as well as paper and the like. The container and the closure components need not be made from the same material. All components of the container system may be made by known methods such as injection molding and compression molding.

Referring to FIGS. 1-8, there is shown an embodiment of maze container system 1 which includes container 5 and closure 15. Closure 15 may be of generally conventional design that has a closed top 16 and cylindrical sidewalls 22 Container 5 may be of any shape and dimension. Typically, container 5 is a cylindrical receptacle of common diameter throughout its length, or of bottle-like form with neck 17 of reduced diameter. Neck 17 includes opening 18 for permitting access to the contents of container 5. Although neck 17 is shown in FIG. 1 as having a narrower diameter than body 19, the configuration of neck 17 is not so limited.

Typically, and as illustrated in FIGS. 1-8, container 5 includes body 19 and neck 17 integral to body 19. Neck 17 is dimensioned to receive closure 15. Neck 17 includes opening 18 for permitting access to the interior of container 5. Although neck 17 is shown in FIG. 1 as having a narrower diameter than body 19, the configuration of neck 17 is not so limited.

Figure 4:
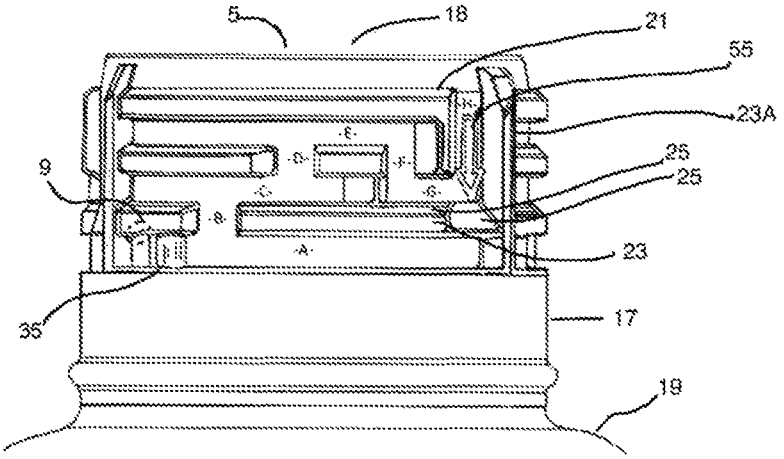
FIG. 4 is a side view of the container of FIG. 1 that shows a configuration of a maze of ribs on the neck of the container of FIG. 1.
Figure 7A:
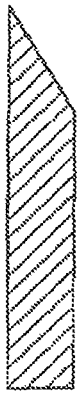
FIGS. 7(A)-7(C) are cross sectional views of alternative shapes of ribs 23.
Figure 7B:
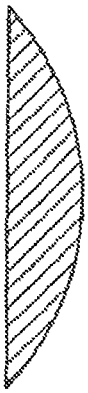
Figure 7C:
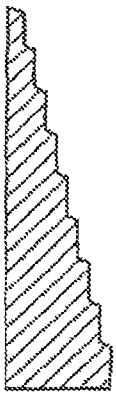
Figure 8:
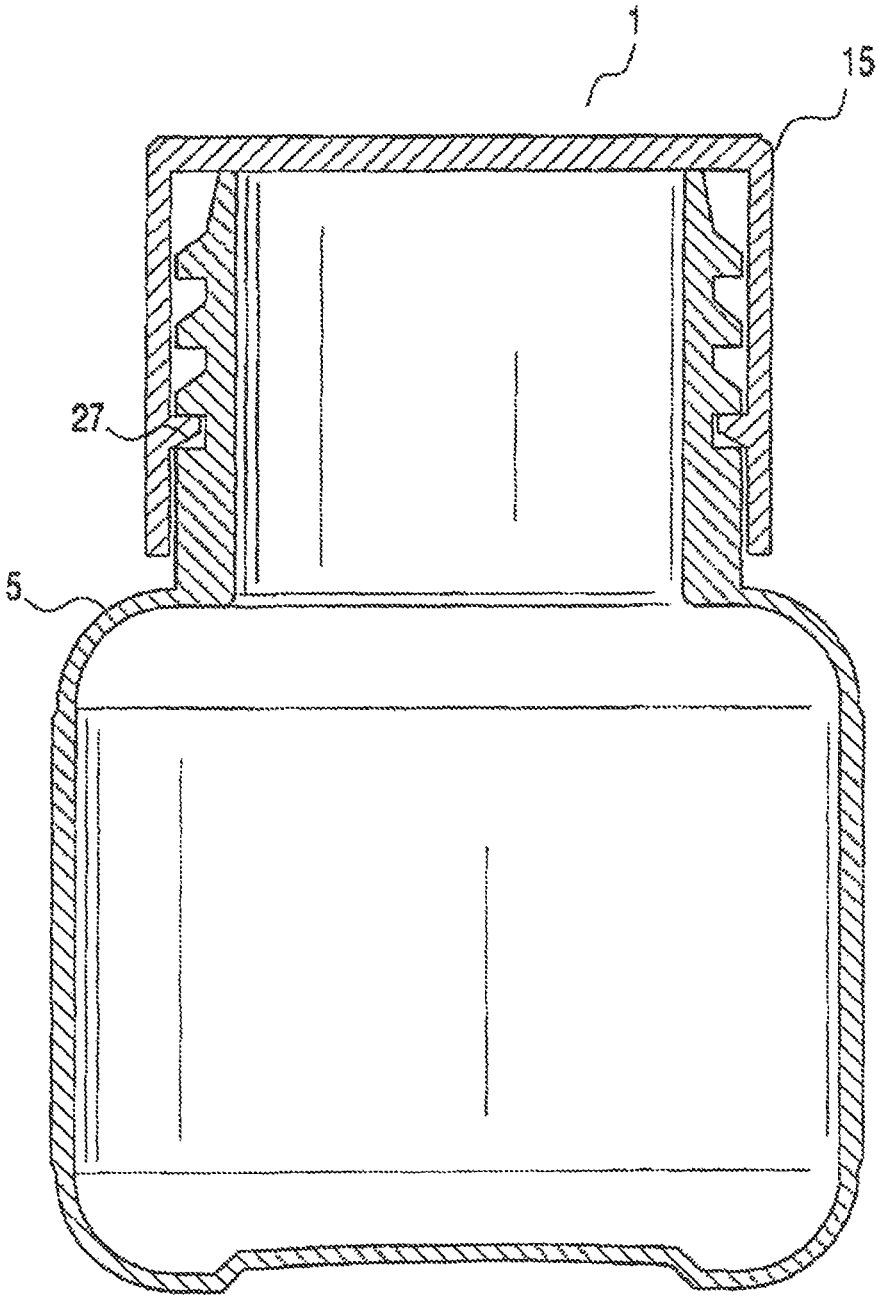
FIG. 8 is a cross sectional assembly view of the maze container system of FIG. 1 that shows the closure attached to the container.

On the outer surface of neck 17 are molded or otherwise provided elevated ribs 23. Ribs 23 form a maze 21 of intersecting axial and circumferential grooves such as shown in FIG. 4. Ribs 23 have lower surfaces 24 which are generally flat, and typically are within ten degrees of perpendicular to the circumferential surface of neck 17. Ribs 23 may vary in cross-sectional shape. Ribs 23 may have a cross section that is generally trapezoidal as shown in FIG. 7(A). Other possible cross sections include but are not limited to hemispherical and stepped as shown in FIGS. 7(B) and 7(C), respectively. Ribs 23 may include downwardly, outwardly tapered portion 25 as shown in FIG. 5A. The angle (β) of tapered portion 25 may vary from about one degree to about 89 degrees, such as about 30 degrees to about 60 degrees, such as about 45 degrees.

Figure 4A:
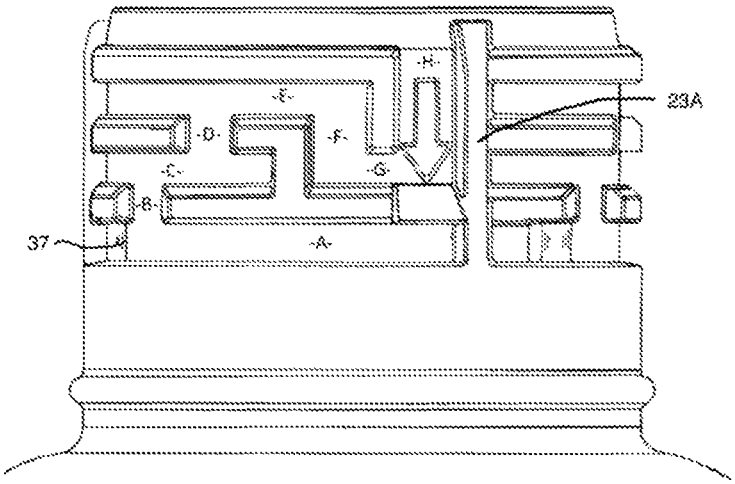
FIG. 4A is side view of the container of FIG. 1 that shows an alternative configuration of a maze of ribs that includes a stud retainer 37.

In an embodiment such as shown in FIG. 4 or 4A, maze 21 includes a number of circumferential and axial grooves (A)-(H) defined by ribs 23. Maze 21 includes axial grooves (B), (D), (F) and (H), and circumferential grooves (A), C), (E) and (G). It is understood that the number of circumferential and axial grooves are not limited to those shown in FIG. 4 or FIG. 4A. One or more of axial grooves (B), (D), (F) and (H) may be vertical or angled in a range of about 1 degree to about 20 degrees to the vertical, such as about 2 to about 3 degrees to vertical. Most typically, the axial grooves are vertical. One or more of circumferential grooves such as grooves (C), (E) and (G) may be horizontal or angled in a range of about 1 degree to about 20 degrees to the horizontal, such as about 2 to about 3 degrees to horizontal. Most typically, the circumferential grooves are horizontal. In FIG. 4, lowermost groove (A) of maze 21 includes detent 35. Detent 35 may secure studs 27 of closure 15 in locking region 9 between detent 35 in groove (A) and the inner wall surface of neck 17. Detent 35 typically is positioned from inner wall surface of neck 17 by a distance that is about equal to the width of stud 27 so as to enable stud 27 to be secured in locking region 9, typically without requiring lateral movement of stud 27 in lowermost groove A. Detent 35, however, may be located a distance of about 11% to about 51% of the length of lowermost groove (A) distal to the inner wall surface of neck 17, such as a distance of about 23% to about 51% of the length of lowermost groove (A) distal to the inner wall surface of neck 17, such as a distance of about 29% to about 51% of the length of lowermost groove (A) distal to the inner wall surface of neck 17. Detent 35 may have a trapezoidal cross section as shown in FIG. 4. Detent 35, however, may have a variety of other cross sections such as hemispherical, ellipsoidal, square, rectangular, triangular and combinations thereof.

In another embodiment such as shown in FIG. 4A, detent 35 in lowermost groove (A) of maze 21 is replaced by stud retainer 37. Stud retainer 37 is typically integral with the bottom surface of groove (A) and extends across a portion of the width of groove (A), such as about 5% to about 100%, such as about 20% to about 50% of groove (A), such as about 100% of the width of groove (A). Stud retainer 37 is shown in FIG. 4A as in the left side section of groove (A). However, the location of stud retainer 37 is not so limited. For example, stud retainer 37 may be located in the right side section of groove (A).

Stud retainer 37 may have a variety of cross sections. Non-limiting examples of possible cross sections for stud retainer 37 include but are not limited to polygons having 3 or more sides, such as 3 to 10 sides, typically four sides, circular cross sections, ellipsoidal cross sections, hemispherical cross sections, concave cross sections, convex cross sections and combinations thereof. Polygonal cross sections may be regular such as square or irregular such as rectangular. Stud retainer 37 functions to secure studs 27 of closure 15 in locking region 9 between stud retainer 37 in groove (A) and the inner wall surface of neck 17. Stud retainer 37 may extend upwardly from the bottom surface of groove (A) to about 0.1 to about 99% of the depth of groove (A), typically about 25% to about 50% of the depth of groove (A) so to enable stud 27 to pass over stud retainer 37 to be secured in locking region 9 while also enabling stud 27 to pass from locking region 9 into groove (A). Stud retainer 37 is typically located adjacent locking region 9. Stud retainer 37, however, may be located in groove (A) distal to locking region 9. As shown in FIGS. 4 and 4A, axial entry-exit groove (H) is partially defined by upwardly extending side wall 23A. Side wall 23A may extend downwardly to the bottom surface of groove (A).

In maze 21, groove (F) may extend above the upper surface of groove (E). Groove (F), alternatively, may terminate at the upper surface of groove (E) so as to not to extend above groove (E). Groove (C) may extend on each side of the intersection with groove (B). Similarly, groove (E) may extend to each side of the intersection of groove (D). Grooves such as (A), (C) and (E), together with studs 27 may limit unintended movement of closure 15 and also minimize the likelihood that a child could forcibly pry closure 15 off of container 5.

Figure 3A:
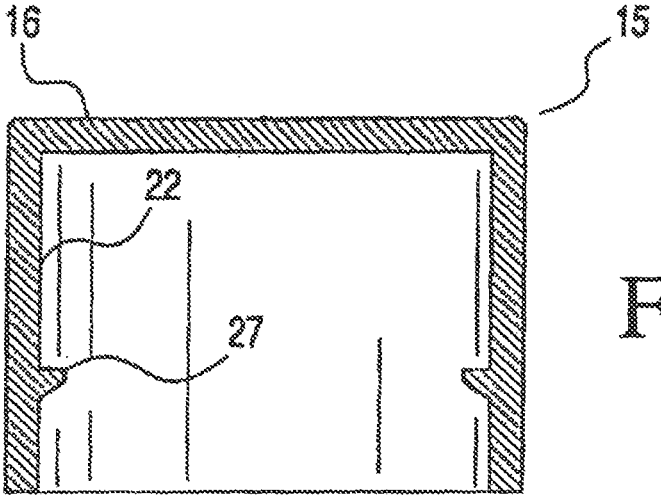
FIG. 3A is a cross sectional view of the closure shown in FIG. 1 taken on line A-A.
Figure 3:
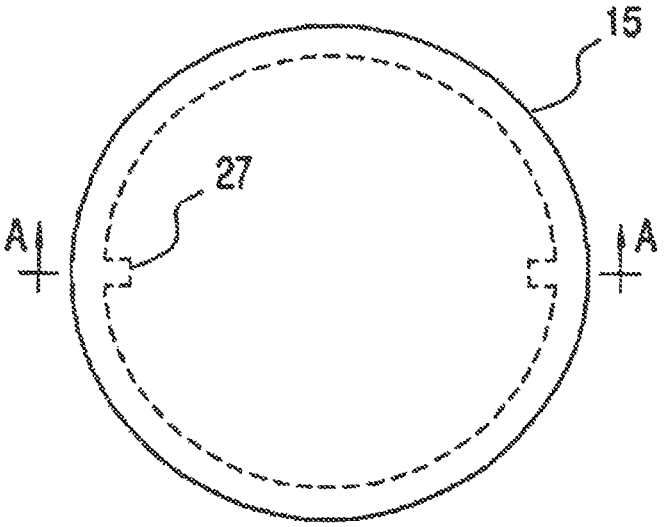
FIG. 3 is a top view of closure 15.
Figure 3B:
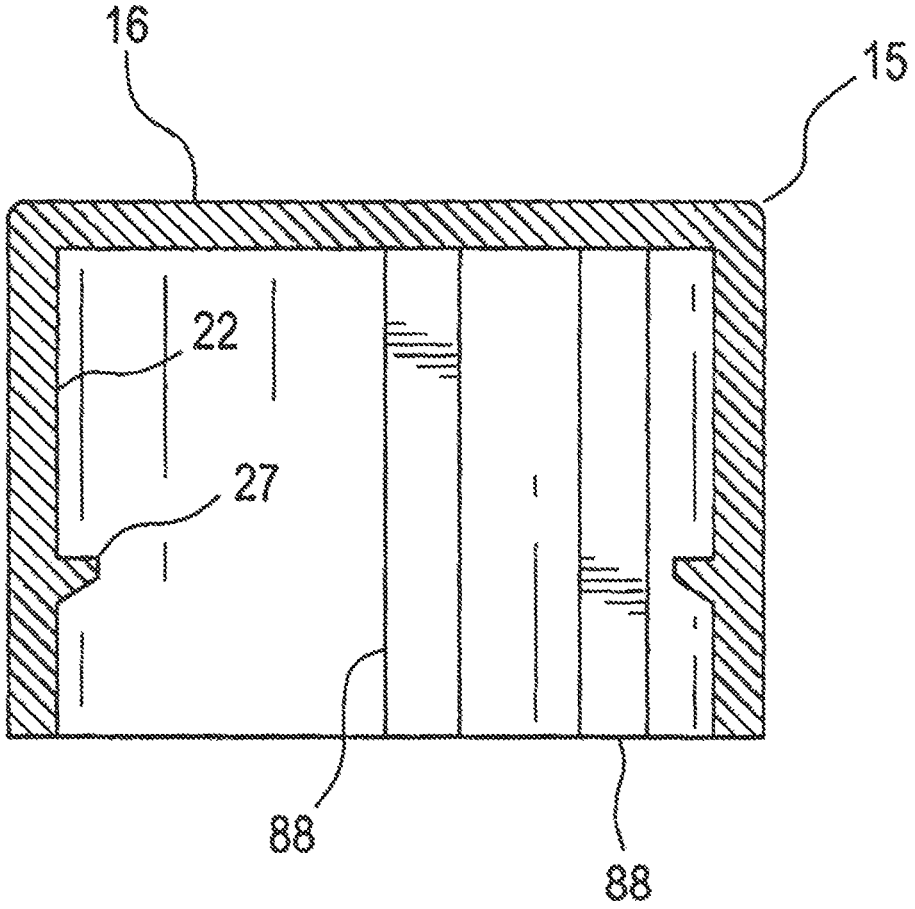
FIG. 3B is a cross sectional view of an embodiment of the closure shown in FIG. 1 that includes studs 27.

Closure 15 may be of generally conventional design that has a closed top 16 and cylindrical sidewalls 22. In an embodiment as shown in FIG. 3B and FIG. 1, closure 15 typically includes a plurality of spaced bars 88 on the interior surface of closure 15. Bars 88 typically are aligned with the vertical axis of closure 15. Closure 15 has a diameter sufficient to fit over neck 17. In an embodiment, closure 15 is unlined. In other embodiments, closure 15 may be lined or linerless (e.g., plug seal). As shown in FIG. 3, two inwardly projecting, diametrically opposed studs 27 are provided on sidewall 22. In this embodiment, there are also two diametrically opposed, individual mazes 21, typically identical mazes 21 spaced about 180 degrees apart around the outer circumferential surface of neck 17.

Figure 6:
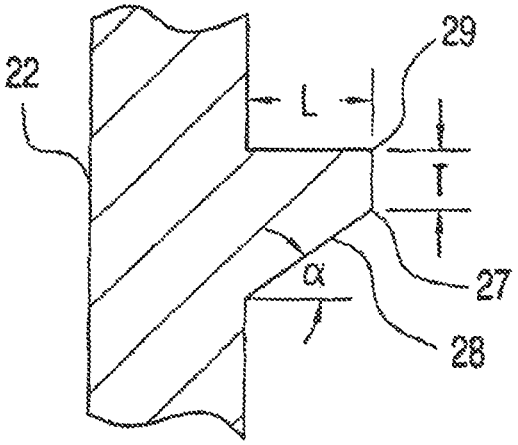
FIG. 6 is a cross section view of an embodiment of stud 27 of closure 15.

In an embodiment, studs 27 may number one, two, three, four or more and may be located equidistantly to each other, typically circumferentially equidistantly to each other. In an aspect, a number of mazes 21, such as identical mazes 21, corresponding in number to the number of studs 27 in closure 15, are provided on neck 17. Studs 27 may have a trapezoidal cross section as shown in FIG. 6. As shown in FIG. 6, stud 27 has an inwardly, downwardly tapered portion 28 and a generally flat, horizontal upper portion 29. Upper portion 29 typically is within thirty degrees of perpendicular to sidewall 22 of closure 15. Tapered portion 28 of stud 27 enables stud 27 to ride over ribs 23 of maze 21 when closure 15 is pushed downwardly onto container 5. This enables a user to snap close closure 15 onto container 5 into a secured position such as in locking region 9.

Studs 27 have a length L and a thickness T sufficient to minimize the possibility that a child may pry closure 15 from container 5. The thickness of stud 27 corresponds to the width of lowermost groove (A) so as to achieve a snug fit of stud 27 in groove (A). The snug fit is sufficient to minimize the possibility of a child rocking closure 15 off of container 5. The angle ($\alpha$) of tapered portion 28, as shown in FIG. 6, may vary from about 1 degree to about 89 degrees, such as about 30 degrees to about 60 degrees, such as about 45 degrees.

Figure 5:
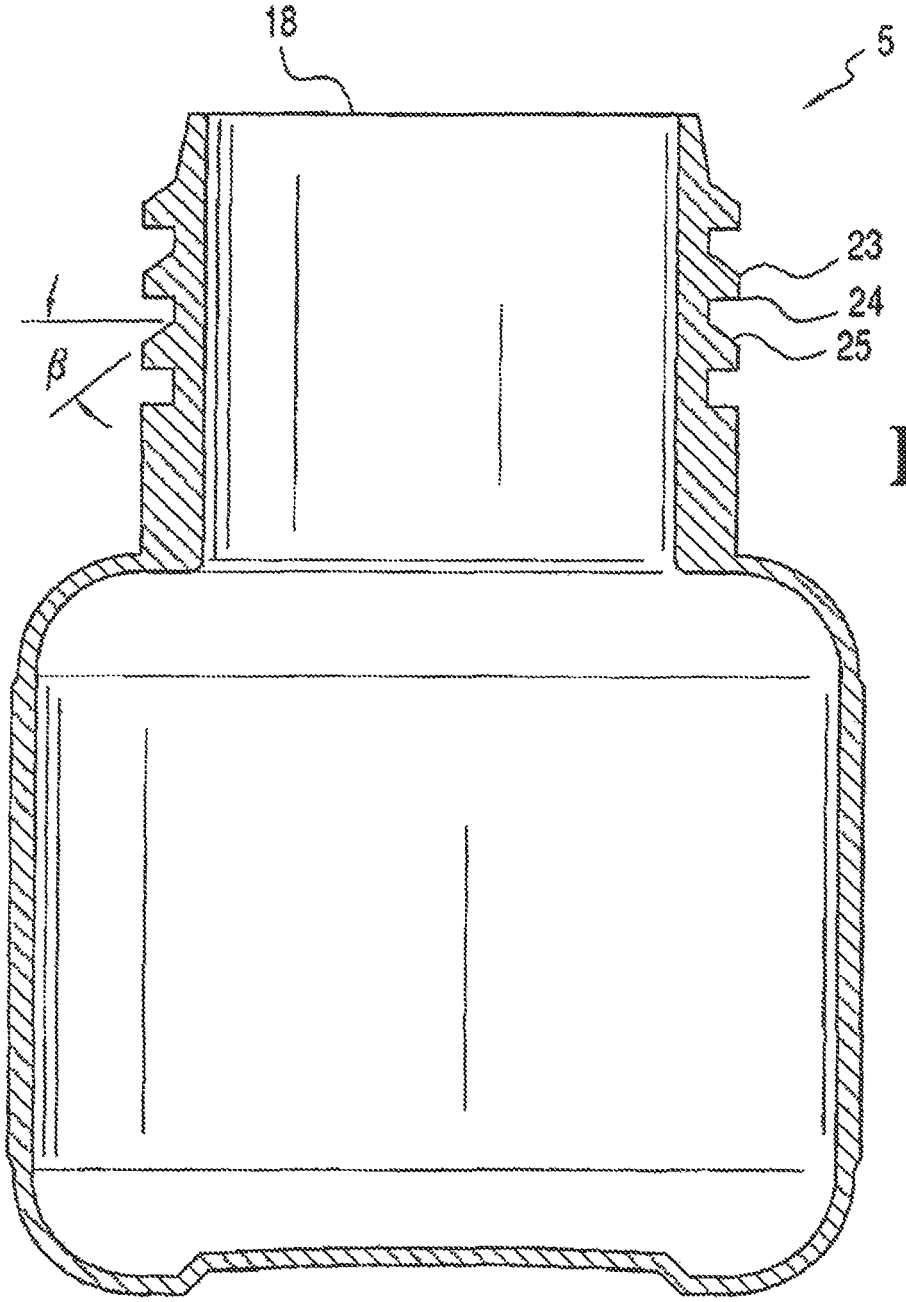
FIG. 5 is a cross sectional view of the container of FIG. 1 showing a rib 23.
Figure 5A:
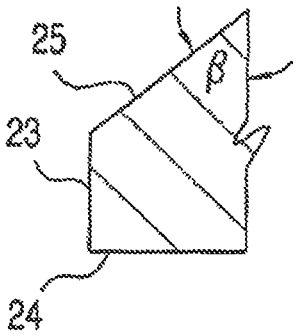
FIG. 5A is an enlarged view of a rib of the maze shown in FIG. 4.

Studs 27 typically may be of a depth and height that corresponds approximately with the depth and height, respectively, of lowermost groove (A) of maze 21 as shown in FIGS. 4 and 5. Where stud retainer 37 is present in groove (A), the depth and height of studs 27 are sufficient to pass over stud retainer 37.

Figure 4B:
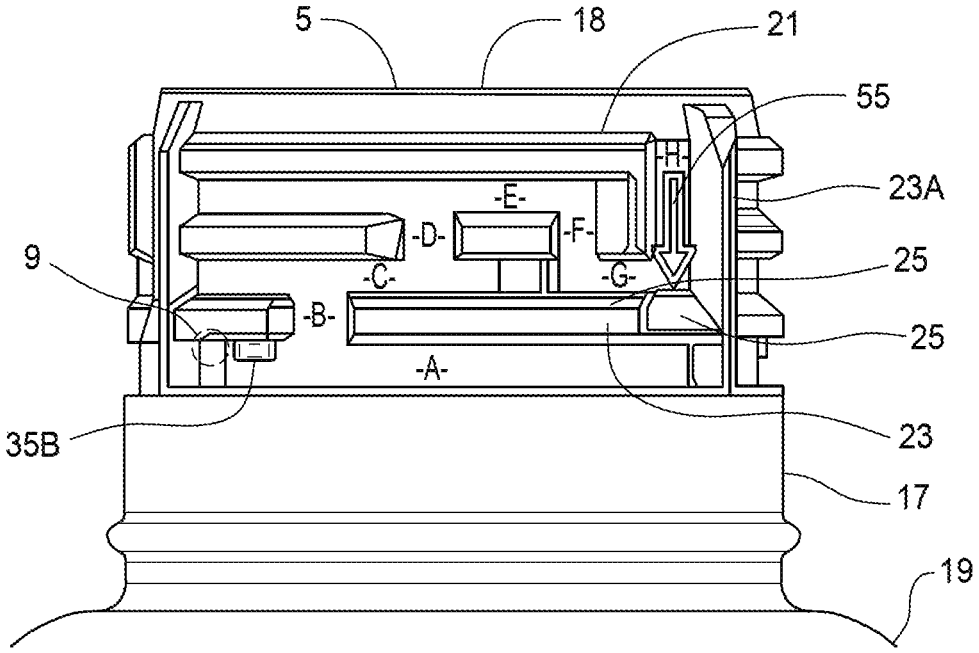
FIG. 4B is side view of the container of FIG. 1 that shows an alternative configuration of a maze of ribs that includes a detent 35B.
Figure 4C:
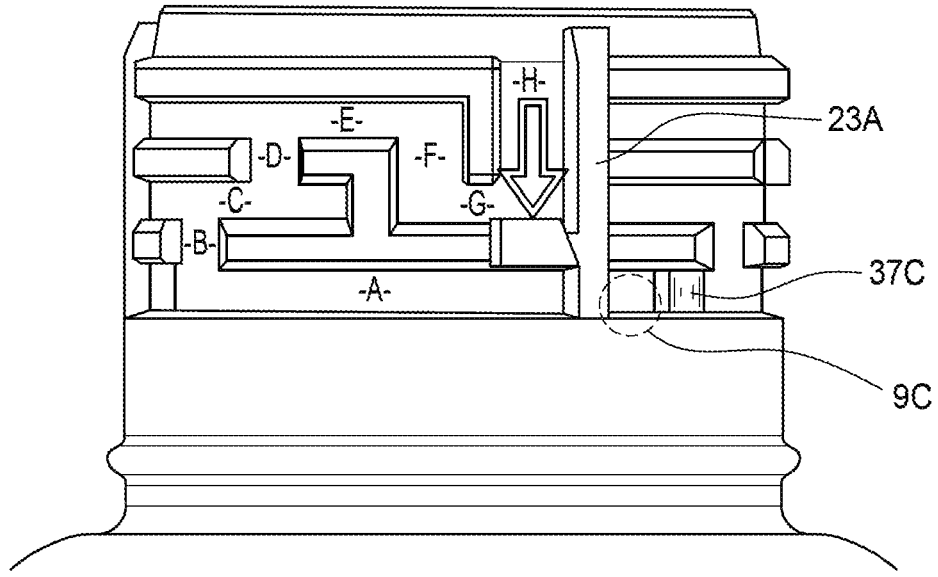
FIG. 4C is side view of the container of FIG. 1 that shows an alternative configuration of a maze of ribs that includes a stud retainer 37C.

When securing closure 15 onto neck 17 of container 5, closure 15 typically may be placed onto neck 17 to cause stud 27 of closure 15 to move in direction of arrow 50 to engage axial entry-exit groove (H) as in FIG. 4. Groove (H) may be identified by arrow 55. Downward pressure then is applied to closure 15 in the direction of arrow 55 to cause stud 27 on closure 15 to pass through circumferential groove (G) and ride over tapered portion 25 into lowermost groove (A). The closure is then turned to engage locking region 9 in lowermost groove (A). Lowermost groove (A), as shown in FIG. 4, includes detent 35 to retain stud 27 in locking region 9. In an embodiment, lowermost groove (A) as shown in FIG. 4A, includes stud retainer 37 to retain stud 27 in locking region 9. In another aspect, FIG. 4C shows stud retainer 37C in locking region 9C. Studs 27 and ribs 23 cooperate to enable closure 15 to be snap closed onto container 5, such as through axial groove H. This encourages adults who lack dexterity to secure closure 15 onto container 5.

When removing closure 15 from container 5, closure 15 is rotated and lifted relative to container 5. In this way, studs 27 on closure 15 pass through mazes 21 to separate closure 15 from container 5. In an embodiment, closure 15 first is rotated to cause stud 27 to pass under detent 35B in lowermost circumferential groove (A) as in FIG. 4B or to ride over stud retainer 37 shown in FIG. 4A to unlock closure 15. Closure 15 then is rotated to cause stud 27 to engage first axial groove (B). Closure 15 then is lifted to cause stud 27 to engage first upper groove (C). Closure 15 is further rotated in groove (C) to cause stud 27 to engage second axial groove (D). Closure 15 then is lifted to cause stud 27 to engage second upper groove (E). Closure 15 then is rotated to cause stud 27 to engage third axial groove (F). At this point, closure 15 is lowered to cause stud 27 to engage third upper groove (G). Subsequently, closure 15 is rotated to cause stud 27 to engage axial entry-exit groove (H). Closure 15 then is lifted to remove closure 15 from container 5. This series of rotary and lifting motions may provide the maze container system with high child resistance. Moreover, adults with limited manual dexterity may readily open the maze container system of the invention.

The disclosed maze container systems may be employed in any application where child-resistant benefits are desired to minimize the likelihood of child access to the contents of a container. The systems therefore may be used in various applications such as but not limited to storing of pharmaceutical products, agricultural products, toxic household chemicals, automotive products and other products with certain levels of specific ingredients that are covered within the CPSC guidelines that may be harmful to children. The systems also may be used to minimize the likelihood of child access to the operating mechanism of devices such as butane lighters, household cleaners, and other devices.

Numerous modifications and variations of the present invention are possible in light of the above teachings. It is therefore understood that within the scope of the appended claims, the invention may be practiced otherwise than as specifically described herein.

The invention claimed is:

1. A container comprising a neck section 17 and a body section 19, the neck section 17 having one or more mazes 21 thereon, wherein at least one of the mazes 21 comprises a plurality of ribs 23 configured to define a first lowermost circumferential groove (A) having a bottom surface and having a locking region 9 having any of a detent and a stud retainer therein, and a second circumferential groove (C) having closed ends, and a third circumferential groove (E), and a fourth circumferential groove (G), and a first axial groove (B), and a second axial groove (D), and a third axial groove (F), and an axial entry-exit groove (H), wherein the second circumferential groove (C) is disposed above the first lowermost circumferential groove (A), the fourth circumferential groove (G) is disposed above the first lowermost circumferential groove (A) and is circumferentially disposed from the second circumferential groove (C) and wherein the third circumferential groove (E) is disposed above each of the first lowermost circumferential groove (A) and the second circumferential groove (C) and the fourth circumferential groove (G), and wherein the first axial groove (B) intersects the first lowermost circumferential groove (A) and the second circumferential groove (C), and wherein the second axial groove (D) intersects the second circumferential groove (C) and the third circumferential groove (E) and wherein the second axial groove (D) is laterally disposed from the first axial groove (B), and wherein the third axial groove (F) intersects each of the third circumferential groove (E) and the fourth circumferential groove (G) and wherein the third axial groove (F) is circumferentially disposed from each of the first axial groove (B) and the second axial groove (D), and wherein the axial entry-exit groove (H) intersects the fourth circumferential groove (G) and, wherein the axial entry-exit groove (H) is circumferentially disposed from each of the third axial groove (F), the second axial groove (D) and the first axial groove (B), and wherein the axial entry-exit groove (H) is configured both to downwardly receive a stud 27 on a closure 15 for securing the closure 15 onto neck section 17 and to upwardly receive stud 27 for removing the closure 15 from neck section 17.

2. The container of claim 1 wherein the locking region 9 has a stud retainer.

3. The container of claim 1 wherein the locking region 9 has a detent.

4. The container of claim 3 wherein the detent has a lowermost surface configured to enable the stud 27 to pass under the lowermost surface of the detent.

5. The container of claim 1 having a plurality of mazes 21.

6. A maze container system comprising a closure 15 and a container 5 having a neck section 17 and a body section 19, the neck section 17 having one or more mazes 21 and an axial entry-exit groove (H) in communication with at least one of the mazes 21 wherein the at least one of the mazes 21 comprise a plurality of ribs 23 configured to define a first lowermost circumferential groove (A) having a bottom surface and a locking region 9 having any of a detent and a stud retainer therein, and a second circumferential groove (C) having closed ends, and a third circumferential groove (E), and a fourth circumferential groove (G), and a first axial groove (B), and a second axial groove (D), and a third axial groove (F), wherein the second circumferential groove (C) is disposed above the first lowermost circumferential groove (A), and wherein the fourth circumferential groove (G) is disposed above the first lowermost circumferential groove (A) and is circumferentially disposed from the second circumferential groove (C) and wherein the third circumferential groove (E) is disposed above each of the first lowermost circumferential groove (A) and the second circumferential groove (C) and the fourth circumferential groove (G), and wherein the first axial groove (B) intersects the first lowermost circumferential groove (A) and the second circumferential groove (C), and wherein the second axial groove (D) intersects each of the second circumferential groove (C) and the third circumferential groove (E) and wherein the second axial groove (D) is laterally disposed from the first axial groove (B), and wherein the third axial groove (F) intersects each of the third circumferential groove (E) and the fourth circumferential groove (G) and wherein the third axial groove (F) is circumferentially disposed from each of the first axial groove (B) and the second axial groove (D), and wherein the axial entry-exit groove (H) communicates with the fourth circumferential groove (G) and, wherein the axial entry-exit groove (H) is circumferentially disposed from each of the third axial groove (F), the second axial groove (D) and the first axial groove (B), wherein the closure 15 comprises a laterally spaced stud 27 for engaging the mazes 21 to secure the closure 15 onto the container 5, wherein the axial entry-exit groove (H) is configured both to downwardly receive stud 27 for securing closure 15 onto neck section 17 and to upwardly receive stud 27 for removing closure 15 from neck section 17.

7. The maze container system of claim 6 wherein the locking region 9 has a stud retainer.

8. The maze container system of claim 6 wherein the locking region 9 has a detent.

9. The maze container system of claim 8 wherein the detent has a lowermost surface configured to enable the stud 27 to pass under the lowermost surface of the detent.

10. The maze container system of claim 6 Having a plurality of mazes 21.

11. The maze container system of claim 6 wherein closure 15 comprises an interior surface having bars 88 on the interior surface.

12. A maze container system comprising a closure 15 and a container 5 having a neck section 17 and a body section 19, the neck section 17 having one or more mazes 21 thereon, the mazes having a plurality of ribs 23 configured to define a first lowermost circumferential groove (A) having a bottom surface and a locking region 9 having any of a detent and a stud retainer therein, and a second circumferential groove (C) having closed ends, and a third circumferential groove (E), and a fourth circumferential groove (G), and a first axial groove (B), and a second axial groove (D), and a third axial groove (F), and an axial entry-exit groove (H), wherein the second circumferential groove (C) is disposed above the first lowermost circumferential groove (A), the fourth circumferential groove (G) is disposed above the first lowermost circumferential groove (A) and is circumferentially disposed from the second circumferential groove (C) and wherein the third circumferential groove (E) is disposed above each of the first lowermost circumferential groove (A) and the second circumferential groove (C) and the fourth circumferential groove (G), and wherein the first axial groove (B) intersects the first lowermost circumferential groove (A) and the second circumferential groove (C), the second axial groove (D) intersects the second circumferential groove (C) and the third circumferential groove (E) and wherein the second axial groove (D) is laterally disposed from the first axial groove (B), and wherein the third axial groove (F) intersects each of the third circumferential groove (E) and the fourth circumferential groove (G) and wherein the third axial groove (F) is circumferentially disposed from each of the first axial groove (B) and the second axial groove (D), and wherein the axial entry-exit groove (H) intersects fourth circumferential groove (G), wherein the axial entry-exit groove (H) is circumferentially disposed from each of the third axial groove (F), the second axial groove (D) and the first axial groove (B), wherein the closure 15 comprises a laterally spaced stud 27 for engaging the mazes 21 to secure the closure 15 onto the container 5, and wherein the axial entry-exit groove (H) is configured both to downwardly receive stud 27 for securing closure 15 onto neck section 17 and to upwardly receive stud 27 for removing closure 15 from neck section 17.

13. The maze container system of claim 12 wherein the locking region 9 includes a stud retainer.

14. The maze container system of claim 12 wherein the locking region 9 includes a detent.

15. The maze container system of claim 14 wherein the detent has a lowermost surface configured to enable stud 27 to pass under the lowermost surface of the detent.

16. The maze container system of claim 12 wherein the neck section 17 includes a plurality of mazes 21.

17. The maze container system of claim 12 wherein closure 15 comprises an interior surface having bars 88 on the interior surface.

* * * * *